United States Patent [19]

Krotseng

[11] Patent Number: 4,793,530

[45] Date of Patent: Dec. 27, 1988

[54] MODULAR AND ADJUSTABLE MANNEQUIN

[76] Inventor: Kathryn G. Krotseng, 5308 Dorchester Rd., Richmond, Va. 23225

[21] Appl. No.: 43,713

[22] Filed: Apr. 29, 1987

[51] Int. Cl.[4] ..... A41H 5/00

[52] U.S. Cl. ..... 223/68

[58] Field of Search ..... 223/68

[56] References Cited

U.S. PATENT DOCUMENTS

| | | | |
|---|---|---|---|
| 272,479 | 2/1883 | Rockwell | 223/68 |
| 377,338 | 1/1888 | Ufford | 223/68 |
| 1,447,866 | 3/1923 | Kramer | 223/68 |
| 2,038,372 | 4/1936 | Linz | 223/68 |
| 3,033,429 | 5/1962 | Richterkessing | 223/68 |
| 3,472,435 | 10/1969 | Maze | 223/68 |
| 4,592,496 | 6/1986 | Nishi | 223/68 |

FOREIGN PATENT DOCUMENTS

| | | | |
|---|---|---|---|
| 2064195 | 6/1981 | United Kingdom | 223/68 |

*Primary Examiner*—Louis K. Rimrodt

[57] ABSTRACT

Disclosed is a mannequin structure having separate parts that can be assembled on a flexible main support which simulates the human spinal column. Included are flexible structures designed to simulate portions of the human anatomy and/or dress forms such as shoulders, limbs, waists, upper and lower torso members and heads, hands, and feet, any or all of which may be used singly or in combination.

14 Claims, 6 Drawing Sheets

FIG. 5A
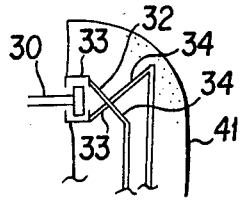
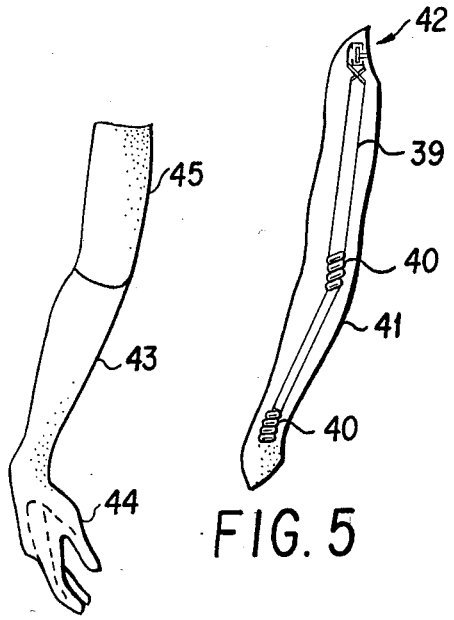
FIG. 5
FIG. 5C
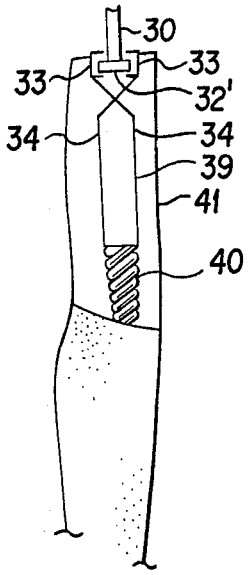
FIG. 5B

MODULAR AND ADJUSTABLE MANNEQUIN

FIELD OF THE INVENTION

This invention relates to mannequins, i.e. an assembly of structures designed to simulate all or portions of a human being; more particularly, the invention relates to structures which are adapted to be assembled selectively to simulate not only certain portions of the human anatomy but which are, moreover, themselves adjustable to allow alteration of the major structural features thereof so as to more closely simulate the variable features of the human anatomy and various associated dress forms.

BACKGROUND OF THE INVENTION

Mannequins are used for a variety of purposes including the exhibition of clothes and/or the tailoring thereof. Particularly in the case of modeling clothes which may be contained in museums, it is desirable, for cost reasons, to create a single and flexible facility by which the clothes may be exhibited. Because clothes contained in museums may span a range of several centuries, with their attendant diversity, not only of the human anatomy as it has evolved, but also to take into account styling variations, it is particularly desirable to create as comprehensive a single system as can be managed and yet still allow the flexibility and adjustability to display such aged clothing of various sorts, sizes, and styles, accurately and without damaging the thus exhibited fragile clothes. Most prior art mannequins of which Applicant is aware have focused primarily on the use of such devices for tailoring clothes, as they are being made for a customer, or to exhibit models of clothes in which the clothes can always be adjusted to the shape of the mannequin. Such an approach is obviously not feasible with clothes that have already been made, which may be located in a museum, and which are often too fragile to be extensively manipulated.

For a more detailed understanding of how the human anatomy, its basic structure, associated clothing and posture styles have changed over the last several hundred years, reference may be had to a number of publications, including the Autumn 1981 issue of "Colonial Williamsburg Today", Volume IV, Number 1. As this article and a number of other publications make clear, not only has human anatomy evolved, particularly in the United States, due principally to dietary factors, but clothing and posture styles have changed as well so as to make the authentic and non-destructive display of these many varied forms of clothes with a single mannequin an extremely difficult proposition.

Accordingly, it is a primary object of this invention to provide a comprehensive mannequin system, comprising several portions, to model various parts of the human anatomy, and having certain features adjustable to more closely approximate both the shape of the varied forms of the human anatomy as well as various clothing styles that may be representative of a museum collection.

Typical prior art efforts in the field are represented by U.S. Pat. No. 377,338 which features a dummy having an adjustable waist length, U.S. Pat. No. 272,479 which discloses a dress form having a complicate series of linkages to adapt the form to the varying shape of a dress, and U.S. Pat. No. 3,472,335 which discloses an adjustable mannequin, adjustable however only in terms of posture and modular only in the sense that various portions of the human anatomy, such as a head, may be detachably mounted to such a mannequin. Insofar as Applicant is aware, neither these references, nor any of the prior art teaches mannequins which are adjustable to conform the mannequin to a given human anatomy in such important areas as the shoulder area, the upper torso area, and the lower torso area.

Accordingly, it is another prime object of this invention to provide a mannequin system which features adjustability of the mannequin in a variety of areas including those portions of a human anatomy corresponding, for example, to the shoulders, the upper torso, and the lower torso.

SUMMARY OF THE INVENTION

According to the invention, a flexible, vertical support means, to simulate the spinal column of a human being, is adapted to have mounted thereon, at selected locations, a variety of structures including structures to simulate the human shoulder, the human upper torso, the human waist, and the human lower torso. These simulating structures are so constructed as to either be themselves adjustable, or allow adjustability of their position on the mannequin, to thereby simulate a variety of human shapes and dress forms.

It is a feature of the invention that the mannequin system disclosed can be adjusted separately in any one or more major parts thereof to also take into account posture and dress style variations, particularly of the range exhibited in a typical museum collection. Thus, for example, molded foam structures molded to resemble the upper torso of the human anatomy also allow variability of these foam structures to illustrate the influence of social customs and mores on dress styles, all as will be explained in greater detail hereinbelow.

It is yet another feature of the invention to allow an easy assembly and disassembly of the various structures, particularly the limb portions, to the mannequin system of the invention by a simple, yet effective joint attachment structure which allows these functions to be carried out while the mannequin is "fully clothed", so to speak.

The foregoing and other objects, features and advantages of the invention will be apparent from the following more particular description of a preferred, embodiment of the invention, as illustrated in the accompanying drawings.

BRIEF DESCRIPTION OF THE DRAWINGS

FIG. 5 shows a cross-sectional view of a limb, such as a human arm, adapted to be attachably mounted to the mannequin system of the invention;

FIG. 5A is a cross-sectional view of the upper limb or arm attachments means of the invention to a shoulder pole embodiment in which the shoulder pole projects laterally;

FIG. 5B is a cross-sectional view of the upper limb or arm attachment means of the invention to a shoulder pole embodiment in which the shoulder pole projects downwardly;

FIG. 5C illustrates a glove-like form that may be slipped over the structure shown in FIG. 5 to simulate a human hand;

DETAILED DESCRIPTION OF THE INVENTION

Figure 1:
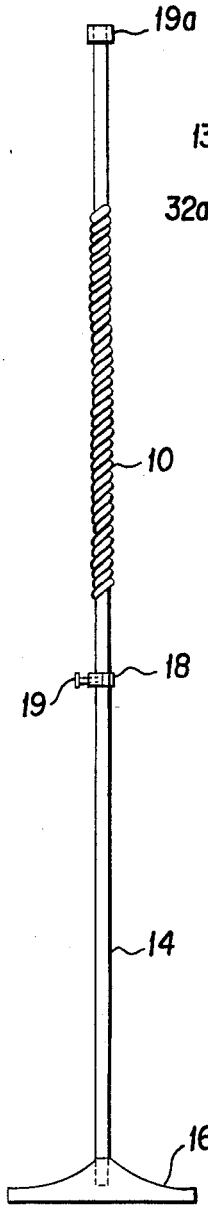
FIG. 1 is a schematic frontal view of certain portions of the adjustable and modular mannequin system of the invention.
Figure 1B:
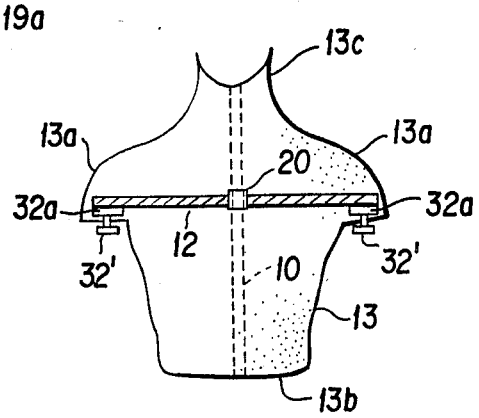
FIG. 1B is a schematic frontal view of one form of a molded foam structure together with a transverse shoulder support having arm attachment means.

With reference to FIG. 1, there is shown a vertical structure designed to simulate the spinal column of a human being, comprised of a flexible pole 10. Pole 10 is preferably made of a bendable, but structurally supportive, material such as, for example, flexpipe, the details of which are well known to those skilled in the art. As shown in FIG. 1B, a slidably mounted on the pole 10 is a transverse support 12, likewise made of a material similar to that used in making pole 10. The transverse shoulder pole 12 is also adapted to be bent, and retain its shape, to the form of the bend, as will be discussed below. Pole 10 is supported Within a hollow tube 14 and is slidably adjustable by a collar 18 affixed to the upper end of the hollow tube 14. Pole 10 can be fixed in position with respect to the tube 14 by means of a screw, diagrammatically indicated at 19, so as to allow a height adjustment between pole 10 and hollow tube 14. The lower end of tube 14 is attached, by conventional means, to a pedestal-like base 16.

Also supported (in a manner to be further described below) on the pole structure 10 and 12 is a molded foam structure 13, molded to resemble the upper torso portion of the human anatomy, as shown in FIG. 1B. The upper torso portion 13 may advantageously be formed in several different sizes and shapes to accommodate various physiological structures as well as dress styles, to include in particular, as shown in FIG. 1B, a foam structure 13 in which the shoulder portions 13*a* extend downwardly to allow very limited arm movement, as was typical of dress forms worn in about 1830, when it was considered unseemly to raise one's upper arms. In contrast with the structure shown in FIG. 1A, the transverse support 12 has mounting plates 32' which are attached to the transverse support 12 in a vertical fashion by fastening means 32*a* for purposes as will be later described. The molded foam structure 13 has a neck portion generally designated by 13*c* and a lower cavity portion generally indicated by 13*b*, all for purposes to be later described.

Figure 1A:
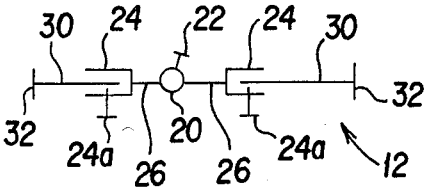
FIG. 1A is a plan view showing the diagrammatic details of a structure designed to simulate the human shoulder anatomy.

With reference to FIG. 1A, the shoulder pole, generally designated by 12, comprises a collar 20 adapted to fit around the pole 10 and a screw, diagrammatically indicated by 22, allowing the collar 20 to be fixed along the length of pole 10 at any desired location by simply tightening the screw 22. The shoulder pole 12 further comprises extensions 26 on either side of the collar 20 which extensions flare out into tubular portions 24 within which are slidably mounted flexible wire portions 30, adapted to be fixed at any desirable location within columns 24 by suitable tightening of the screws designated 24*a*. Also affixed to the extremities of the sliding flexible wire portions 30, are mounting plates 32 the function of which will be discussed below.

Figure 2:
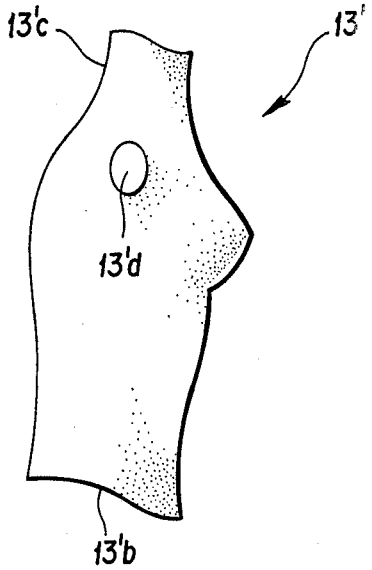
FIG. 2 shows a side view of one form of a molded foam structure to resemble the upper torso of the human female anatomy.

With reference to FIG. 2, there is disclosed a lateral view of a molded foam portion, generally designated 13', of a shape typical of the human female anatomy. The foam of which the foam structure 13' is made may be any suitable foam which can be molded into any desired shape and which has sufficient structural rigidity to be self-supporting. It is important to note also that the foam is inert, i.e. it will not react with garment materials.

Further reference to FIG. 2 discloses that the upper body molded foam structure 13' is particularly characterized by openings 13'*a* at a location generally characteristic of the shoulder and upper arm joint of the human anatomy and also has an opening 13'*b* in the lower portion of such molded structure, for purposes as will be later described. Furthermore, the molded foam torso structure 13' has a portion 13'*c* formed therein designed to simulate a portion of the human neck structure, for purposes as will be later described herein. In contrast with the foam structure 13 illustrated in FIG. 1B, the foam structure 13' shown in FIG. 2 is usable in those instances where the rounded shoulder version shown in FIG. 1B is inappropriate.

In practice, the foam structure 13 (13'), which may be made in several sizes and shapes, including variable shoulder lengths, is positioned on pole 10 to be supported by the transverse support 12 which can be adjusted to variable shoulder lengths as previously described and thereby protrude through the opening 13*a*. Moreover, by selectively bending the transverse support 12, a general tilt of the shoulder form can be achieved so as to more closely adapt the mannequin to this variability of the human anatomy. In either case, the foam structure 13 is made in a hollow form so that the openings 13*b* (13'*b*) allow the foam structure 13 to be slipped over the transverse support 12 and be supported thereby.

Figure 3:
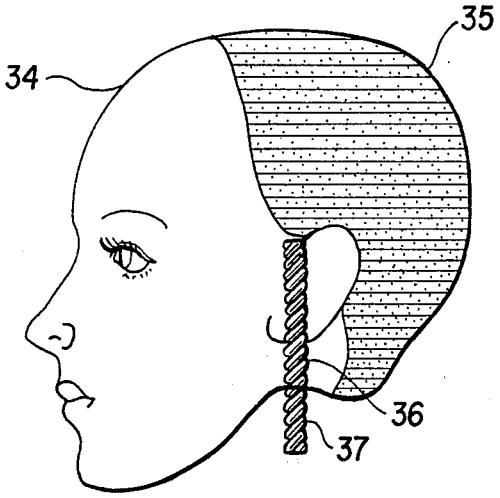
FIG. 3 shows a side view of a structure designed to be detachably mountable into the mannequin system of the invention to resemble a human head.

With reference to FIG. 3, there is shown there, in side view, a molded plastic structure 34 generally resembling that of a human head and including the facial portions thereof. In particular, the head structure includes a portion 35 designed to be made of any suitable foam to allow that portion of the human head structure to resiliently yield for a variety of head coverings, or hats. The head 34 is adapted to receive a solid shaft 36, the lower end of which has threads 37 formed thereon so as to allow the head structure to be inserted, and screwed into, an internally threaded collar portion 19 at the extremity of flexible pole 10. Into the internally threaded portion of collar 19 (FIG. 1) there may also be inserted a hook arrangement to allow the flexible pole 10, together with its attachments, to be suspended, for example, in a closet. It will be appreciated by those skilled in the art that the facial portion of the head structure may be made of a suitable foam which allows the application and removal of makeup to further enhance the life-like appearance of a mannequin according to the invention.

Figure 4:
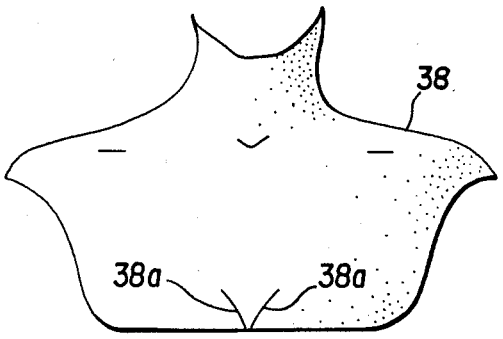
FIG. 4 shows a front view of an upper body yoke designed to cooperate with the upper torso portion of the invention to more closely simulate the human anatomy.

With reference to FIG. 4, there is shown in frontal view an upper body yoke 38 made of a suitable injected foam, as is otherwise well known to those skilled in the art. This upper body yoke is designed to fit over the neck portion 13*c* (see FIGS. 1B and 2) of the upper torso portion 13. It is particularly preferable to utilize the yoke 38 especially to give the upper portion of the torso of the mannequin a more skin-like appearance by suitable choice of materials as well as to help simulate, as by the cleavage lines 38*a*, the particularities of the human female anatomy.

With reference to FIG. 5, there is shown there a structure designed to simulate a human arm comprised of a strong wire 39 having selectively weakened, and bendable portions 40 at various joint portions, such as the shoulder joint, the elbow joint and the wrist joint, all encased in a suitable foam 41, of a type well known to those skilled in the art. At the upper extremity of the structure there is a fastening means, generally indicated by the numeral 42, allowing this limb to be attached to the plate 32 of shoulder pole 12 (see FIGS. 1 and 1A).

With reference to FIGS. 5A and 5B, where like parts have been designated with like numerals, there are shown the details of the particularly effective means of attaching the limbs to the shoulder plate 32 (32') of the two versions of the transverse support 12 shown in FIGS. 1A and 1B. In both cases, a wire like clamp 33 frictionally engages the plate 32 (32') by means of pressure which can be relieved (to detach the arm) by suitable manual pressure on the wire structure 33 at locations 34. This allows removal, as well as positioning, of the limb by the application of manual pressure, even when the limb is encased in clothing.

With reference now to FIG. 5C, there is disclosed a flexible glove-like structure, generally designated 46, comprising a hollow upper arm section 45 mating with a hollow lower arm section 43 to which is attached a human hand simulating structure 44, the latter comprised by bendable wires 44*a* contained within the structure 44. In practice, the glove-like structure 46 may be "pulled over" the limb simulating structures of the invention such as disclosed in FIG. 5.

Figure 6:
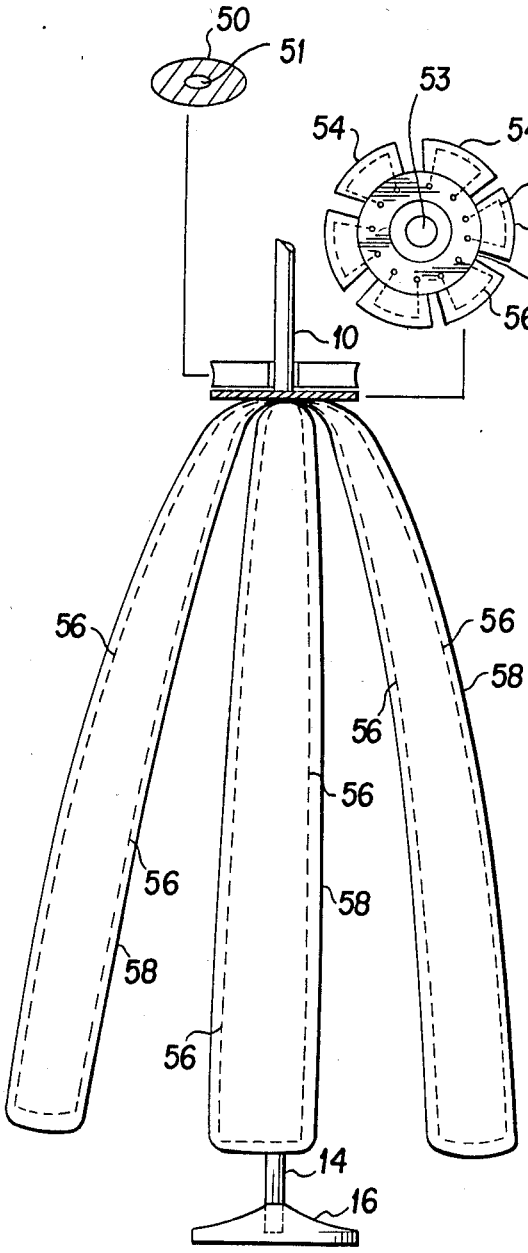
FIG. 6 shows a front, and partially exploded, view of several portions of the invention designed to simulate the lower torso portion, with or without skirt, of the human anatomy.

With reference now to FIG. 6, there is shown a frontal and partially exploded view of elements comprising the significant structural elements of the lower torso portion of a mannequin system according to the invention. This structure comprises, first of all, at least one generally circular or slightly oval shaped piece of foam 50 having therethrough a hole 51 so that at least one or more of these elements may be suitably slipped onto pole 10 to simulate the human waist structure, in accordance with the shape of the human anatomy designed to be simulated, or the dress to be accommodated. Immediately beneath the foam piece 50 is an attachment disc 52 having therein a hole 53 also adapted to be slidably mounted on pole 10 having means therein (not shown), such as a screw, or the like, allowing the attachment disc 52 to be fixed in location along pole 10. The attachment disc 52 has a series of radially-spaced protrusions 54 adapted to engage flexible wires 56, of suitable length, and which may optionally be suitably encased with a common foam material 58. The flexible wires 56 are of such a nature that they may be bent to any desired shape, such as that shown in FIG. 6A, for example, to adapt to the form of a gown that was traditionally worn in the 1870s. In a similar manner, the structure may also be adapted to the shape shown in FIG. 6B which is typical of a gown form that was popular in 1770.

Figure 6C:
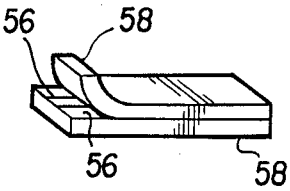
FIG. 6C shows details of the foam around wire structure generally disclosed in FIG. 6.
Figure 6A:
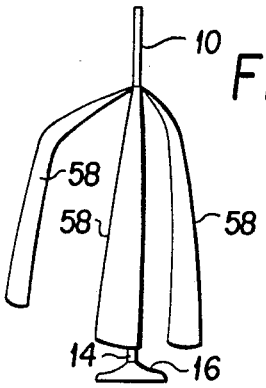
FIG. 6A shows a lateral view of how the structure shown in FIG. 6 may be formed to model a particular style of gown.
Figure 6B:
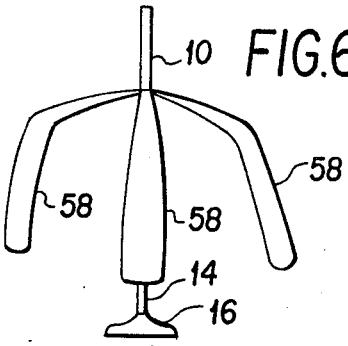
FIG. 6B shows another lateral view of how the structure shown in FIG. 6 may be formed to model another particular style of gown.

With reference to FIG. 6C, there is shown there the details of how the wire 56, which may be made of any bendable wire suitably strong to support some moderate weight, is encased or sandwiched by two strips of suitable foam 58 being glued together.

Figure 7:
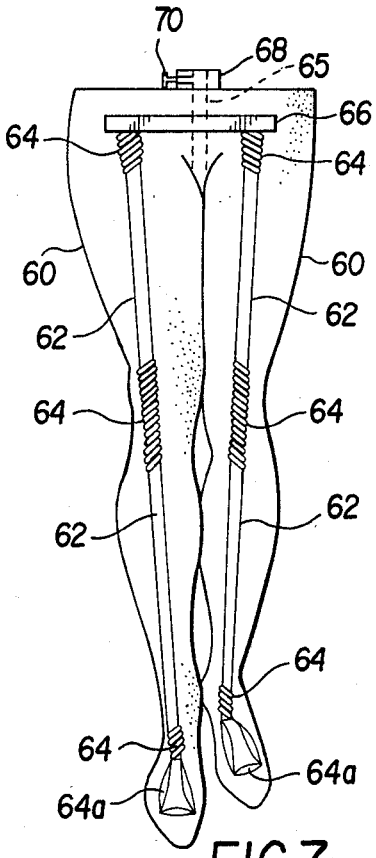
FIG. 7 shows a front view of a foam encased structure, together with mounting means, designed to simulate the lower torso, or limb, portions of a human anatomy.
Figure 7A:
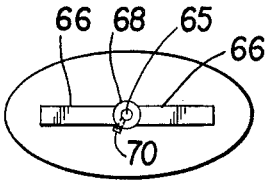
FIG. 7A is a top view of details of the supporting structure for the limb portions illustrated in FIG. 7.

With reference to FIG. 7, there is shown there structure, in a front view, suitable to simulate the lower torso of the human anatomy, particularly the limbs and their associated parts. The structure generally comprises a molded foam 60, molded in the shape of the human anatomy, into which is inserted in the limb portions thereof a flexible pipe 62, particularly and selectively designed to flex at joint locations 64 to simulate hip, knee, and ankle joints. In addition, the structure comprises a hollow tube 65 inserted into the upper extremity of the structure at the end whereof there is a collar 68 together with a screw 70. A top view of this structure is shown in FIG. 7A and indicates that transversely extending arms 66 are made of the same material as the flexible pipe 62 comprised to define the major extent of the hip portion of the human anatomy and the hollow tube 65 allows the entire structure thus described to be slidably attached to the pole 10 above the upper end of tube 14 (see FIG. 1) and fixed in location with respect thereto by suitable tightening o the screw 70. The depth of the hollow portion 65 may be suitably adjusted to allow positioning of the lower torso portion with respect to all the other portions of the mannequin system previously described. Further reference to FIG. 7 will show that the foot portion of the lower body torso structure so far described is formed by wire structures 64*a* which are also bendable to a particular shape.

Figure 7B:
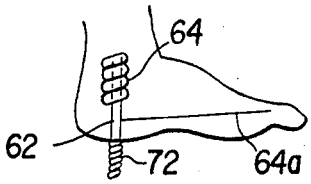
FIG. 7B shows a sectional side view of means to attach the limb portions shown in FIG. 7 to a fixed support; and, FIG. 8 is a frontal view of one embodiment of the modular mannequin system of the invention assembled in a composite form.

With reference to FIG. 7B, there is shown there a lateral view of the foot portion of the structure shown in FIG. 7 to particularly illustrate that by the addition of a threaded extension 72 attached to the flexible joint 64, the feet of the mannequin may be screwed into the floor to thus provide support for the entire mannequin structure.

Figure 8:
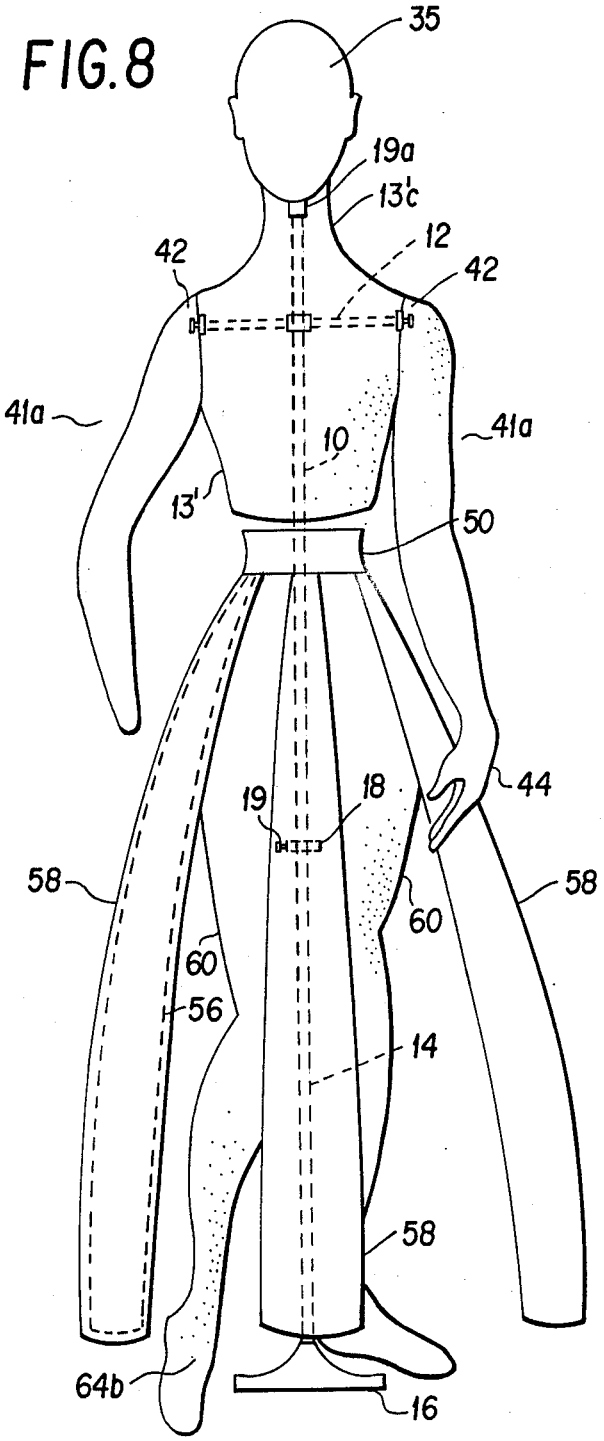

With reference to FIG. 8, there is shown there an assembled structure of a reasonably complete mannequin system according to the invention. A head portion 35 is attached to pole 10 together with an upper torso portion 13' supported by the transverse support 12. The upper torso portion 13' is of the type previously described in which there are no rounded shoulders (as described wit reference to FIG. 2) so that the upper limb portions 41*a* can be attached to the transverse support 12 by way of the attachment structure 42 previously described. One of the limbs has pulled over it the hand-like glove structure 46 previously described with reference to FIG. 5C. A waist piece 50, previously described with reference to FIG. 6, is supported on pole 10 above the attachment disc 52 (FIG. 6), which is not shown in FIG. 8. However, shown in FIG. 8 are the bendable, optionally foam encased, members 58 which are fastened to attachment disc 52 and which provide the support for any desired gown structure as previously described. Furthermore, FIG. 8 also illustrates the use of a lower torso structure 60 (previously described with reference to FIG. 7) together with the members 58, although this may not be necessary or desirable in each case.

The main supporting structure, comprised of pole 10, tube 14, collars 18 and 19*a* and screw 19 are shown in hidden lines to indicate with the same reference numerals those parts previously described. A base 16 is shown in this embodiment to provide the necessary ground support for the entire mannequin system because the foot, generally designated by 64*b*, is raised for artistic effect after having been suitably bent to this posture in a manner described with reference to FIG. 7.

It is evident that an extremely adaptive and adjustable system has been described allowing a mannequin to be adjusted for a variety of clothing, and allowing adjustment in a number of major structural features, such as height, spinal curvature, shoulder curvature, waist structure, posture structure, and dress structure. Thus, one basic design can be suitably altered to accommodate a variety of human anatomical forms and dresses, in a simple and inexpensive fashion, thereby making such structures eminently usable in a variety of environments, including museums.

The embodiments of the invention in which an exclusive property or privilege is claimed are defined as follows:

1. A modular and adjustable mannequin system comprising:

a flexibly adjustable vertical support means for simulating the spinal column of the human anatomy, said vertical support means being adjustable to simulate various curvatures of said spinal column;

flexibly adjustable and transversely extendable support means adapted to slide along said flexible vertical support means for simulating the shoulder structure of the human anatomy and being adjustable to simulate various curvatures of said shoulder structure, said flexibly adjustable and transversely extendable support means including means for fixing its location along said flexibly adjustable vertical support means; and, main support means adapted to have slidably mounted with respect thereto said flexible vertical support means, said main support means including means for fixing the position of said flexible vertical support means with respect to main support means.

2. A system according to claim 1 wherein said flexible and transversely extendable support means include end plates adapted to attachably receive extensions simulating the arms and hands of the human anatomy.

3. A modular and adjustably mannequin system comprising:

a flexibly adjustable support means for simulating the spinal column of the human anatomy, said vertical support means being adjustable to simulate various curvatures of said spinal column;

flexibly adjustable and transversely extendable support means adapted to slide along said flexible vertical support means for simulating the shoulder structure of the human anatomy and being adjustable to simulate various curvatures of said shoulder structure, said flexibly adjustable and transversely extendable support means including means for fixing its location along said flexibly adjustable vertical support means; and, a molded foam piece, molded to resemble the upper torso portion of the human anatomy, said molded foam piece having means thereon for allowing said flexibly adjustably and transversely extendable support means to support, and to protrude therethrough, said molded foam piece.

4. A system according to claim 3 further including a molded foam structure resembling the lower torso and limbs of the human anatomy, adapted to be slidably mounted on said flexibly adjustable vertical support means.

5. A system according to claim 4, further including a flexible and bendable structural support within said foam structure for allowing said limbs to be flexibly positionable to simulate a variety of positions of the limbs.

6. A modular and adjustable mannequin system comprising:

a flexibly adjustable vertical support means for simulating the spinal column of the human anatomy, said vertical support means being adjustable to simulate various curvatures of said spinal column;

flexibly adjustable and transversely extendable support means adapted to slide along said flexible vertical support means for simulating the shoulder structure of the human anatomy and being adjustable to simulate various curvatures of said shoulder structure, said flexibly adjustable and transversely extendable support means including means for fixing its location along said flexibly adjustably vertical support means;

a molded foam piece, molded to resemble the upper torso portion of the human anatomy, said molded foam piece having means thereon for allowing said flexibly adjustable and transversely extendable support means to support, and to protrude therethrough, said molded foam piece; and, attachment means adapted to slide along said flexibly adjustable vertical support means and being fixable in location with respect thereto, said attachment means having attached thereto a plurality of flexible members bendable so as to simulate the shape of a dress on a human being.

7. A system according to claim 6 further including at least one generally waist-shaped member adapted to slide along said flexibly adjustable vertical support means above said attachment means.

8. A system according to claim 6 further comprising a molded upper body yoke adapted to be placed slidably along said flexibly adjustable vertical support means above said molded foam piece.

9. A modular and adjustable mannequin system comprising:

a flexibly adjustable vertical support means for simulating the spinal column of the human anatomy, said vertical support means being adjustable to simulate various curvatures of said spinal column;

attachment means adapted to slide along said flexibly adjustable vertical support means and being fixable in location with respect thereto, said attachment means having attached thereto a plurality of flexible members bendable so as to simulate the shape of a dress on a human being.

10. A system according to claim 9 further comprising flexibly adjustable and transversely extendable support means adapted to slide along said flexibly adjustable vertical support means for simulating the shoulder structure of the human anatomy, said flexible and transversely extendable support means for fixing its location along said flexibly adjustable vertical support means.

11. A system according to claim 9 wherein said flexibly adjustable and transversely extendable support means include end plates to attachably receive extensions simulating the arms and hands of the human anatomy.

12. A system according to claim 11 further including an upper limb structure attached to said end plates for simulating the arms and hands of the human anatomy.

13. A system according to claim 12 further comprising a glove structure to resemble the hand portion of the human anatomy adapted to be pulled over said upper limb structure.

14. A system according to claim 12 further including limb attachment means for attaching said upper limb structure to said end plate, said limb attachment means including a clamp-like structure having opposed ends and designed to clamp said end plate between the opposed ends of said clamp-like structure.

* * * * *